US005806118A

United States Patent [19]

Lerner

[11] Patent Number: 5,806,118

[45] Date of Patent: Sep. 15, 1998

[54] SPACER PARTICULARLY USEFUL IN A COMBINED HEADREST, SUNSHADE AND HANDBAG

[76] Inventor: Reuven Lerner, 11 Nordau, 62495 Tel Aviv, Israel

[21] Appl. No.: 863,934

[22] Filed: May 27, 1997

[30] Foreign Application Priority Data

Jun. 11, 1996 [IL] Israel ..... 118620

[51] Int. Cl.[6] ..... A47G 9/00; B65D 30/00

[52] U.S. Cl. ..... 5/639; 5/656; 135/133; 135/151; 403/84

[58] Field of Search ..... 5/656, 643, 639, 5/419, 414, 416; 135/132, 133, 151, 909; 383/4; 190/1; 403/84

[56] References Cited

U.S. PATENT DOCUMENTS

| | | | |
|---|---|---|---|
| 2,932,833 | 4/1960 | Wambach | 5/656 |
| 3,241,160 | 3/1966 | Escobar | 5/656 |
| 4,425,675 | 1/1984 | Victor | 5/656 |
| 4,639,958 | 2/1987 | Lerner | 5/656 |
| 5,515,564 | 5/1996 | Lyons | 5/639 |

*Primary Examiner*—Alexander Grosz
*Attorney, Agent, or Firm*—Mark M. Friedman

[57] ABSTRACT

A spacer for alternately spacing apart and collapsing a first member and a second member which are pivotable about a pivot point. The spacer includes a planar sleeve for accommodating a portion of the first member and a ramped protrusion connected to, or integrally formed with, the sleeve portion for retaining the second member in a spaced apart position relative to the first member. The spacer is formed with an opening for accommodating a fastener for pivotably fastening ends of the first member and second member together.

4 Claims, 4 Drawing Sheets

SPACER PARTICULARLY USEFUL IN A COMBINED HEADREST, SUNSHADE AND HANDBAG

FIELD AND BACKGROUND OF THE INVENTION

The present invention relates to a spacer and, more particularly, to a device for alternately deploying and collapsing a sunshade, especially a sunshade which is a portion of a combined headrest, sunshade and handbag.

As disclosed in U.S. Pat. No. 4,639,958, which is incorporated in its entirety for all purposes as if fully set forth herein, it is sometime desirable to combine in a single item a headrest, sunshade and handbag.

A typical example of a combined headrest, sunshade and handbag disclosed in U.S. Pat. No. 4,639,958 is shown in FIGS. 1 and 2. The head rest is formed by a bag 10 which is substantially of the shape of half a cylinder and which is affixed by shackles or loops 12 to a skeleton on which it is held stretched. The skeleton is formed by a bar, preferably of metal, bent to form two semi-circular bows 14 which are positioned in two parallel planes. The ends of bows 14 are connected by straight rods 16.

From the zenith of the two bows 14, and hingedly attached thereto at a connection point 18, extend two additional bows members 20 and 22. On the two bow members 20 and 22 is stretches a textile or plastic sheet 24. At its lateral end, bag 10 is closed by a flap 26 which can be secured by a slide fastener 28.

The two bow members 20 and 22 are interconnected by a pair of links 30, each pair being made up of two pivotally connected rods. When links 30 are in the erected position (FIG. 1) bow members 20 and 22 are held apart from one another thereby serving to stretch sheet 24. When desired, links 30 can be rotated, by pushing upward at or near the pivot points, into a non-erected position (FIG. 2) allowing bow members 20 and 22 to pivot toward each other for storage and/or transport.

A disadvantage of using links 30 such as those shown in FIGS. 1 and 2 in this and in other similar applications is that there is a great tendency for the user to get his finger caught by links 30 in the process of collapsing the structure.

There is thus a widely recognized need for, and it would be highly advantageous to have, a mechanism for alternately erecting and collapsing a structure such as that described above without the use of links and the attendant dangers and discomfort.

SUMMARY OF THE INVENTION

According to the present invention there is provided a spacer for alternately spacing apart and collapsing a first member and a second member which are pivotable about a pivot point, comprising: (a) a substantially planar sleeve portion for accommodating a portion of the first member; (b) a ramped protrusion connected to, or integrally formed with, the sleeve portion for retaining the second member in a spaced apart position relative to the first member; the spacer being formed with an opening therethrough for accommodating a fastener for pivotably fastening ends of the first member and second member together.

Also according to the present invention, there is provided a device for use as a headrest, sunshade and a handbag, comprising: (a) a stiff skeleton including laterally spaced apart upright side frame members at respective lateral ends thereof and connecting frame means extending laterally between the frame members to connect the side frame members; (b) a closable handbag supported on the skeleton to provide a flexible headrest, the handbag being separate from the connecting frame means, the handbag having a flexible upper portion extending between and stretched by the frame members and the frame members supporting the flexible upper portion against collapse onto a lower portion of the handbag to provide the flexible headrest and further to provide between the upper and lower portion a hollow space within the handbag for storage of articles in the handbag even during use of the device as a headrest, the flexible upper portion being attached at its lateral ends to the upright side frame members by loops; (c) a foldable sunshade connected to the skeleton, the foldable sunshade including a pair of bows hinged to the side frame members of the skeleton substantially at the midpoints of the side frame members and a sheet held on the pair of bows; and (d) a spacer for alternately spacing apart and collapsing the pair of bows, the spacer including: (i) a substantially planar sleeve portion for accommodating a portion of the first member; (ii) a ramped protrusion connected to, or integrally formed with, the sleeve portion for retaining the second member in a spaced apart position relative to the first member; the spacer being formed with an opening therethrough for accommodating a fastener for pivotably fastening ends of the first member and second member together.

The present invention successfully addresses the shortcomings of the presently known configurations by providing a simply and reliable mechanism for alternately erecting and collapsing a pair of members, especially a pair of bows which form a portion of a combined headrest, sunshade and handbag, without the use of links and the attendant dangers and discomfort associated with getting fingers caught in the links during deployment.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a spacer which can be used as part of a combined headrest, sunshade and handbag.

The principles and operation of a spacer according to the present invention may be better understood with reference to the drawings and the accompanying description.

Figure 1:
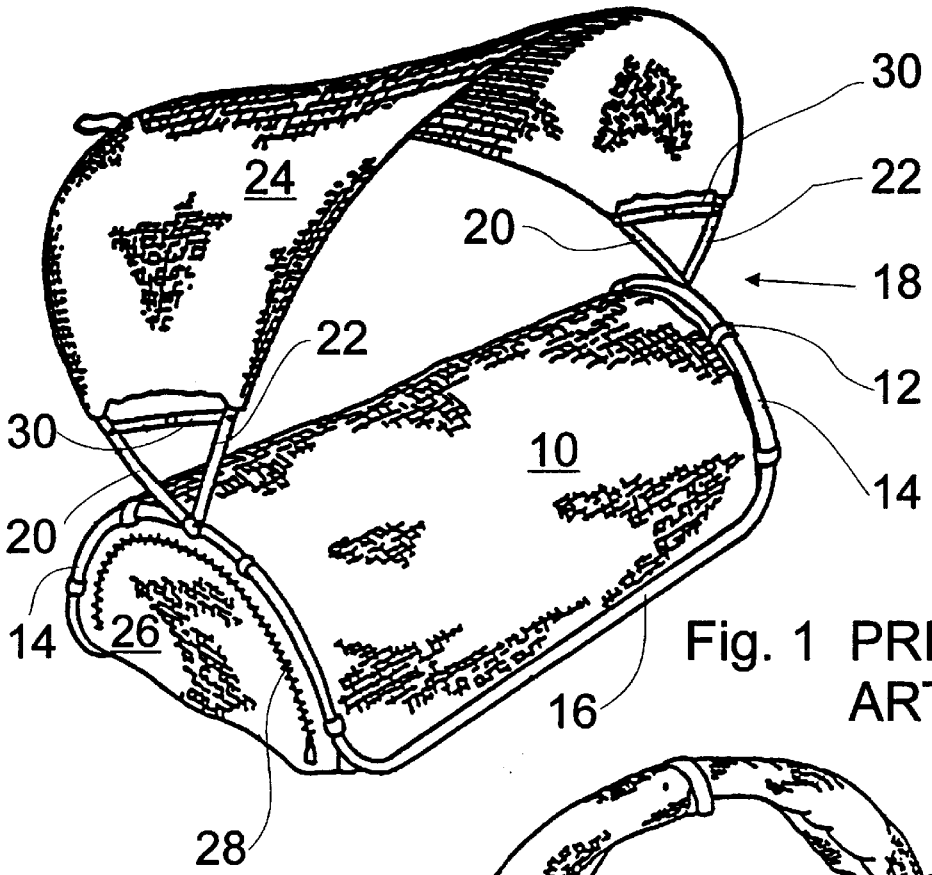
Fig. 1 PRIOR ART
FIG. 1 shows a prior art combined headrest, sunshade and handbag when the sunshade is in the open position.
Figure 2:
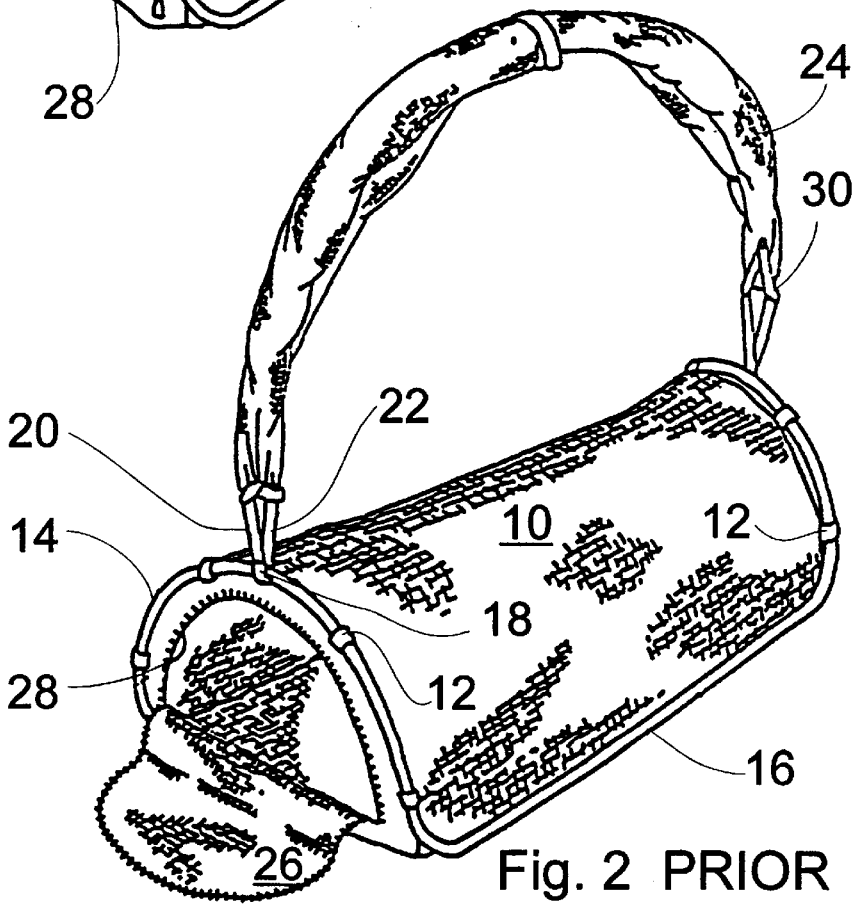
Fig. 2 PRIOR ART
FIG. 2 shows the device of FIG. 1 with the sunshade in the closed position.
Figure 3:
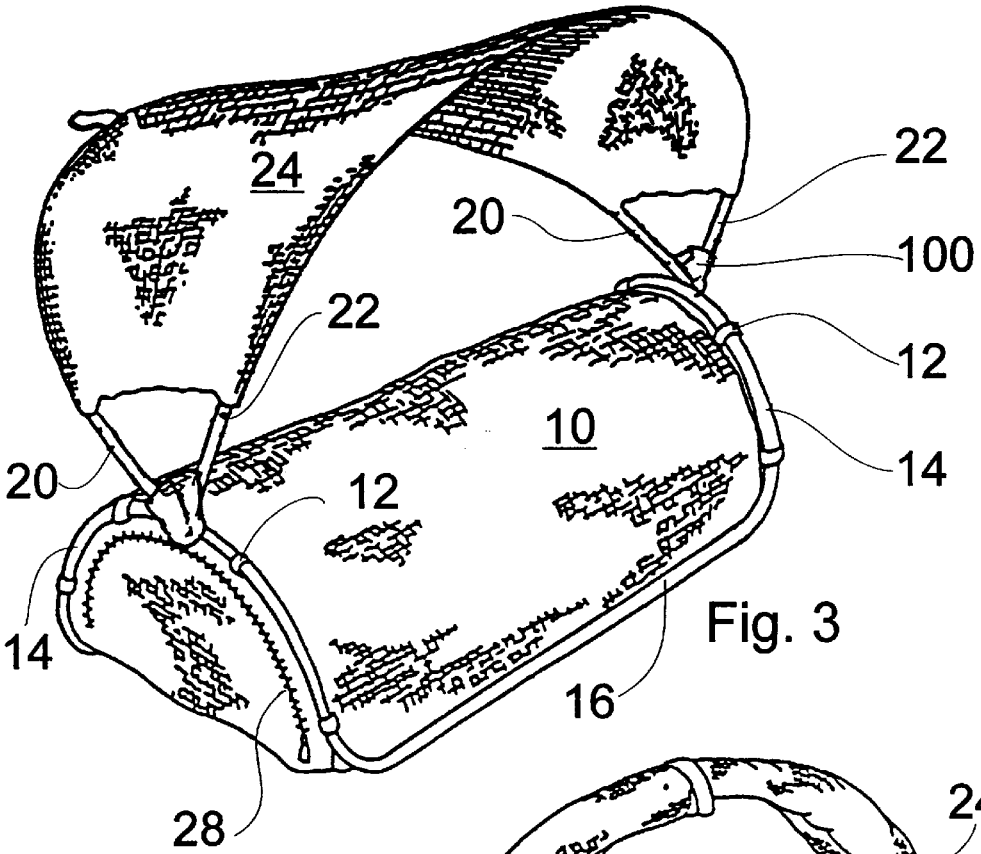
FIG. 3 shows a combined headrest, sunshade and handbag featuring a spacer according to the present invention when the sunshade is in the open position.

Referring now to the drawings, FIGS. 2 and 3, which correspond to the prior art FIGS. 1 and 2 described in detail above, illustrate a combined headrest, sunshade and handbag which utilizes a spacer 100 according to the present invention. It is to be noted that links 30 of FIGS. 1 and 2 are completely absent.

An illustrative spacer 100 according to the present invention is depicted in more detail in FIGS. 5–15.

Figure 5:
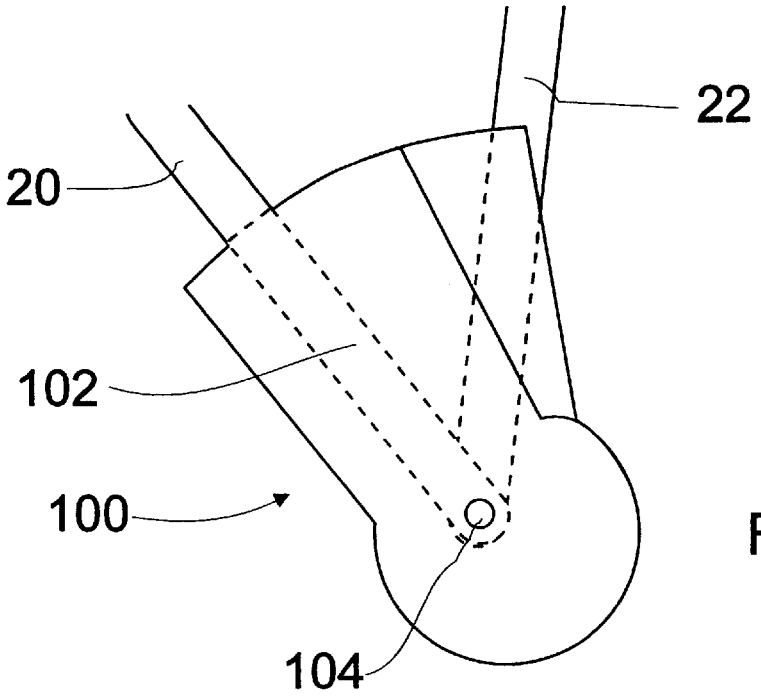
FIG. 5 is a close up view of one side of a spacer according to the present invention.
Figure 6:
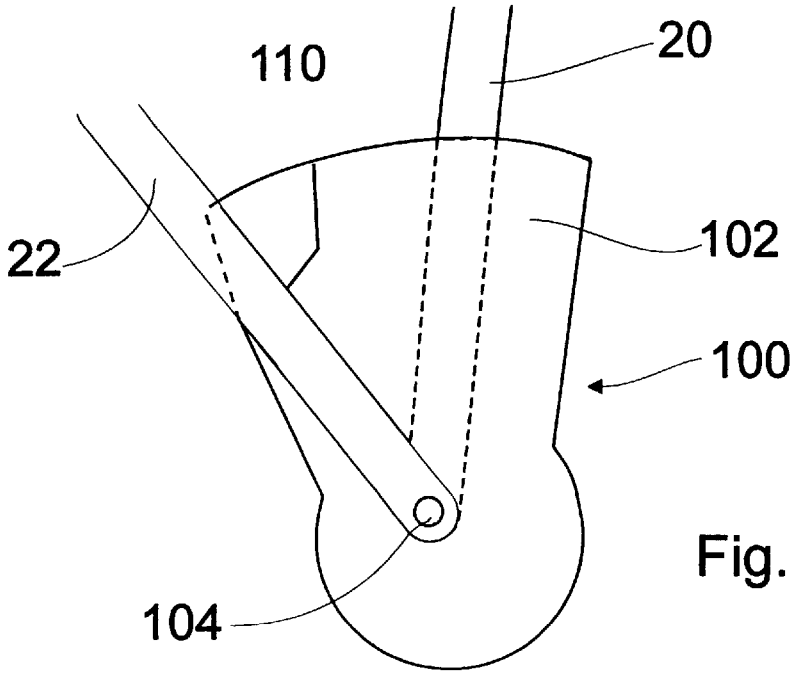
FIG. 6 is a close up view of the other side of the spacer of FIG. 5.
Figure 9:
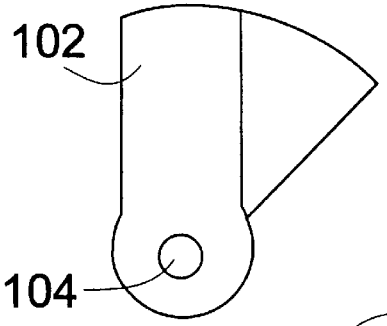
FIG. 9 is a plan view of the spacer of FIG. 5.
Figure 13:
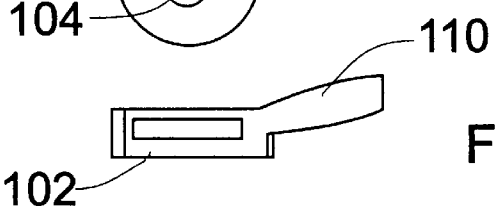
FIG. 13 is an end view of the spacer of FIG. 14.
Figure 15:
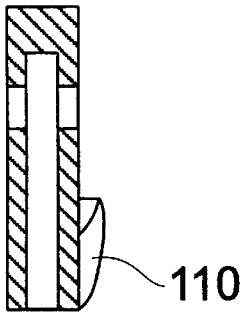
FIG. 15 is a cross sectional view along A—A in FIG. 14.
Figure 14:
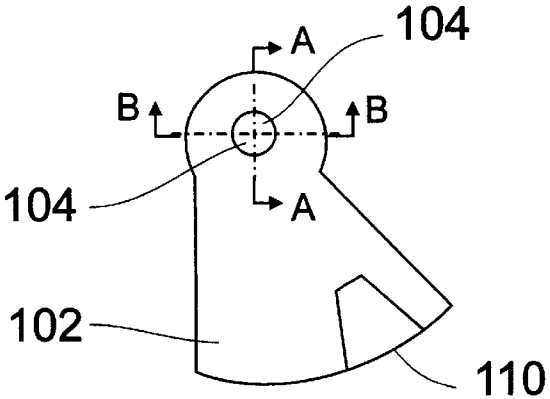
FIG. 14 is a plan view of the spacer of FIG. 5.
Figure 8:
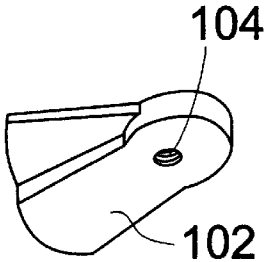
FIG. 8 is a perspective view of a spacer according to the present invention showing a second side of the spacer.
Figure 12:
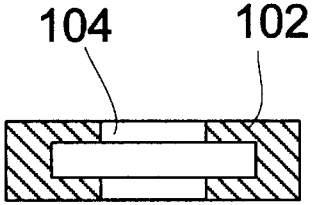
FIG. 12 is a cross sectional view along B—B in FIG. 14.
Figure 7:
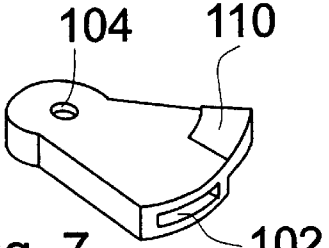
FIG. 7 is a perspective view of a spacer according to the present invention showing a first side of the spacer.
Figure 10:
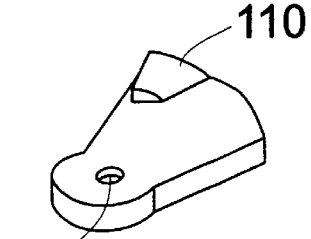
FIG. 10 is another perspective view of the spacer of FIG. 7.
Figure 11:
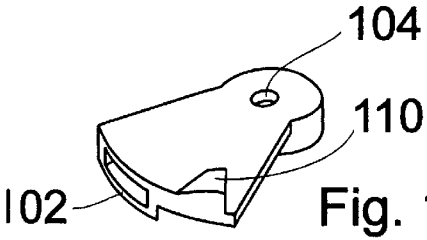
FIG. 11 is yet another perspective view of the spacer of FIG. 7.

Shown in FIGS. 5 and 6 are two opposing views of spacer 100 as it would appear when deployed with first member 20 and second member 22 being spaced apart. It will readily be appreciated that, while the description herein is, for ease of presentation, largely concerned with a spacer in the context of a combined headrest, sunshade and handbag, spacer 100 may be used in a variety of other applications, all of which are intended to be included herein. Thus, for example, first member 20 and second member 22 are not necessarily the bows of FIGS. 2 and 3 but may be any other members in any other application.

As can be seen in FIGS. 5 and 6, and in the associated FIGS. 7–15, spacer 100 includes a substantially planar sleeve portion 102 which defines a hollow region for accommodating a portion of first member 20. Alternatively, sleeve portion 102 may be permanently connected to, or integrally formed with, first member 20 in some suitable fashion.

Spacer is formed with an opening 104 therethrough which is sized and located to accommodate a suitable fastener (not shown) which pivotably fastens the ends of first member 20 and second member 22 together. The fastening is such that first member 20 and second member 22, while being connected to each other, are still free to rotate relative to each other about their common pivot point.

Spacer 100 is characterized in that it includes a ramped protrusion 110 which projects out of the plane defined by sleeve portion 102 on one side (FIG. 6) of spacer 100. Ramped protrusion 110 may be connected to sleeve portion 102 and is preferably integrally formed with sleeve portion 102. Spacer may be made of any suitable material but is preferably made of plastic, most preferably of a suitable metal.

The function of ramped protrusion 110 is to retain second member 22 in a spaced apart position relative to first member 20. The precise operation of spacer 100 and specifically of ramped protrusion 110 may be described with reference to FIGS. 5–15.

To first install spacer 100, first member 20 is inserted through sleeve portion 102 so that the hole at the end of sleeve portion 102 is substantially aligned with opening 104 in spacer 100. Second member 22 is held against the surface of spacer 100 bearing protrusion 110 so that its hole is also aligned with opening 104 in spacer 100 (and thus with the hole at the end of sleeve portion 102). A suitable fastener (not shown) is then passed through the holes in first member 20 and second member 22 and through opening 104 so as to hold together first and second members, 20 and 22, and spacer 100.

To deploy the device, second member 22 is forced rotated about the pivot point away from first member 20. If sufficient force is applied, second member 22 moves up ramped protrusion 110. Further rotation of second member 22 allows second member to slide past the end of ramped protrusion, whereupon, the elasticity of second member 22 causes it to move toward spacer 100 where it lodges and is unable to move back towards its earlier position (FIG. 6).

To collapse the structure, force must be applied by the user in a direction extending normally away from spacer 100 so as to allow second member 22 to clear the end of ramped protrusion 110. After ramped protrusion 110 has been cleared, the user can readily rotate second member 22 to within close proximity of first member 20.

Figure 4:
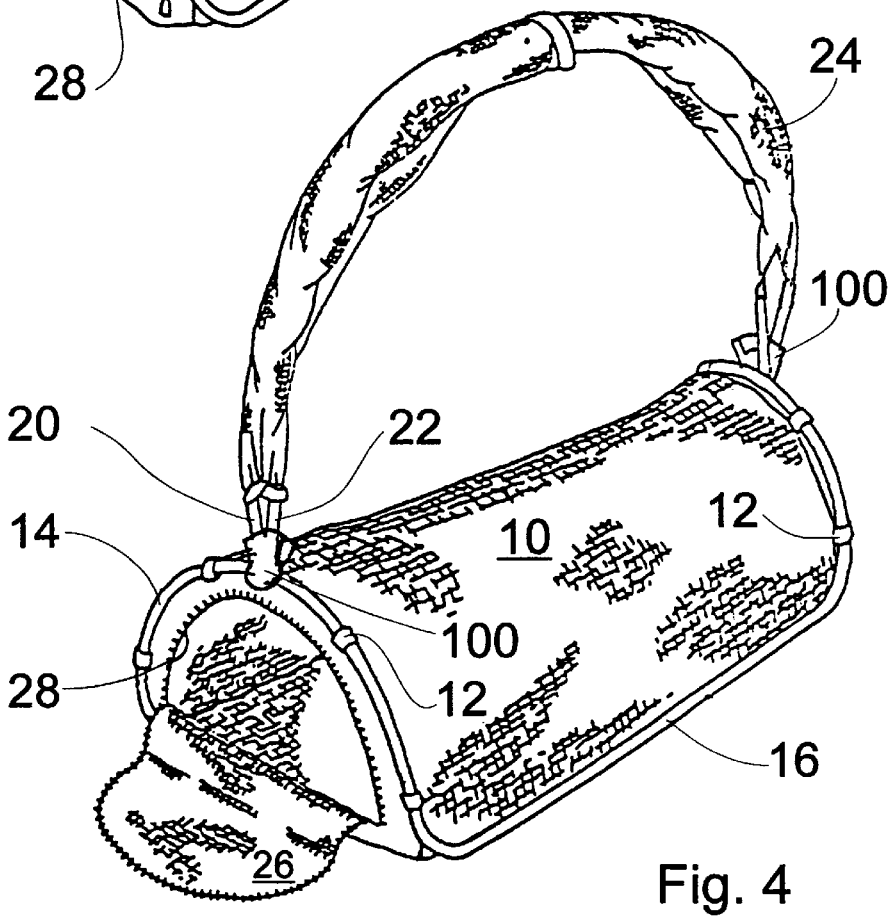
FIG. 4 shows the device of FIG. 3 with the sunshade in the closed position.

A spacer according to the present invention is most advantageously used in a combined headrest, sunshade and handbag such as that shown in FIGS. 3 and 4.

Here, the device features a stiff skeleton which includes laterally spaced apart upright side frame members at respective lateral ends thereof and connecting frame means which extend laterally between the frame members to connect the side frame members.

The device further includes a closable handbag which is supported on the skeleton to provide a flexible headrest. The handbag is separate from the connecting frame means. The handbag has a flexible upper portion which extends between, and is stretched by, the frame members. The frame members support the flexible upper portion against collapse onto a lower portion of the handbag to provide the flexible headrest and further to provide between the upper and lower portion a hollow space within the handbag for storage of articles in the handbag even during use of the device as a headrest. The flexible upper portion is attached at its lateral ends to the upright side frame members by loops.

The device further includes a foldable sunshade which is connected to the skeleton. The foldable sunshade includes a pair of bows which are hinged to the side frame members of the skeleton substantially at the midpoints of the side frame members. A sheet made of suitable material, such as plastic or cloth, is held on the pair of bows.

Finally, a device according to the present invention includes a spacer such as described above for alternately spacing apart and collapsing the pair of bows.

While the invention has been described with respect to a limited number of embodiments, it will be appreciated that many variations, modifications and other applications of the invention may be made.

What is claimed is:

1. A spacer for alternately spacing apart and collapsing a first member and a second member which are pivotable about a pivot point, comprising:

(a) a substantially planar sleeve portion for accommodating a portion of the first member;

(b) a ramped protrusion connected to, or integrally formed with, said sleeve portion for retaining the second member in a spaced apart position relative to the first member;

the spacer being formed with an opening therethrough for accommodating a fastener for pivotably fastening ends of the first member and second member together.

2. The spacer of claim 1, wherein said sleeve portion is permanently connected to, or integrally formed with, the first member.

3. A device for use as a headrest, sunshade and a handbag, comprising:

(a) a stiff skeleton including laterally spaced apart upright side frame members at respective lateral ends thereof and connecting frame means extending laterally between said frame members to connect said side frame members;

(b) a closable handbag supported on said skeleton to provide a flexible headrest, said handbag being separate from said connecting frame means, said handbag having a flexible upper portion extending between and stretched by said frame members and said frame members supporting said flexible upper portion against collapse onto a lower portion of said handbag to provide the flexible headrest and further to provide between said upper and lower portion a hollow space within said handbag for storage of articles in said handbag even during use of said device as a headrest, said flexible upper portion being attached at its lateral ends to said upright side frame members by loops;

(c) a foldable sunshade connected to said skeleton, said foldable sunshade including a pair of bows hinged to said side frame members of said skeleton substantially at the midpoints of said side frame members and a sheet held on said pair of bows; and (d) a spacer for alternately spacing apart and collapsing said pair of bows, said spacer including:

(i) a substantially planar sleeve portion for accommodating a portion of a first bow member;

(ii) a ramped protrusion connected to, or integrally formed with, said sleeve portion for retaining a second bow member in a spaced apart position relative to the first bow member;

the spacer being formed with an opening therethrough for accommodating a fastener for pivotably fastening ends of the first bow member and second bow member together.

4. The device of claim 3, wherein said sleeve portion of said spacer is permanently connected to, or integrally formed with, the first bow member.

* * * * *